US008713841B2

(12) United States Patent
Lippard

(10) Patent No.: US 8,713,841 B2
(45) Date of Patent: May 6, 2014

(54) FIREARM LUBRICATION SYSTEM

(71) Applicant: Karl Clark Lippard, Colorado Springs, CO (US)

(72) Inventor: Karl Clark Lippard, Colorado Springs, CO (US)

( * ) Notice: Subject to any disclaimer, the term of this patent is extended or adjusted under 35 U.S.C. 154(b) by 0 days.

(21) Appl. No.: 13/655,166

(22) Filed: Oct. 18, 2012

(65) Prior Publication Data

US 2013/0133235 A1 May 30, 2013

Related U.S. Application Data

(63) Continuation of application No. 13/365,164, filed on Feb. 2, 2012, now Pat. No. 8,312,658, which is a continuation of application No. 12/509,322, filed on Jul. 24, 2009, now Pat. No. 8,132,352.

(60) Provisional application No. 61/085,765, filed on Aug. 1, 2008.

(51) Int. Cl.
*F41C 27/00* (2006.01)

(52) U.S. Cl.
USPC ..... 42/85; 42/106

(58) Field of Classification Search
USPC ..... 42/75.01, 75.02, 75.03, 85, 106
See application file for complete search history.

(56) References Cited

U.S. PATENT DOCUMENTS 3,411,407 A * 11/1968 Pachmayr et al. ..... 89/196

* cited by examiner

*Primary Examiner* — Benjamin P Lee
(74) *Attorney, Agent, or Firm* — Martensen IP

(57) ABSTRACT

A firearm system includes lubrication notches are incised into portions of the frame and slide along the region of interaction between these two components. The notches act as reservoirs of lubrication and upon each cycling movement of the slide (firing of the weapon) one or more of the notches is placed opposite a corresponding portion of the slide or frame. The notches themselves are never exposed to the environment and thus retain the lubricant, unlike topically applied material. As a result, the frame and slide are lubricated during each cycle of the slide.

15 Claims, 10 Drawing Sheets

FIREARM LUBRICATION SYSTEM

CROSS-REFERENCE TO RELATED APPLICATIONS

The present application is a continuation of U.S. patent application Ser. No. 13/365,164 filed Feb. 2, 2012, which is a continuation of U.S. Pat. No. 8,132,352 B2 issued on Mar. 13, 2012 both of which claims the benefit of priority to U.S. Provisional Patent Application No. 61/085,765 filed 1 Aug. 2008, all of which are hereby incorporated by reference in their entirety for all purposes as if fully set forth herein.

BACKGROUND OF THE INVENTION

1. Field of the Invention

Embodiments of the present invention relate, in general, to handheld firearms and particularly to an improved handgun system.

2. Relevant Background

The M1911-A1 is a single-action, semi-automatic pistol (handgun) chambered for the .45 Automatic Colt Pistol cartridge. It was designed by John M. Browning and was the standard-issue side arm for the United States armed forces from 1911 to 1985; it is still carried by many U.S. forces. It was widely used in World War I, World War II, the Korean War and the Vietnam War. Its formal designation as of 1940 was Automatic Pistol, Caliber .45, M1911-A1 for the original Model of 1911 or Automatic Pistol, Caliber .45. The model M1911-A1 was adopted in 1924. In total, the United States has procured to date around 2.7 million M1911-A1 and M1911-A1 pistols.

The M1911-A1 is also the most well-known of John Browning's designs to use the short recoil principle in its basic design. Besides the pistol being widely copied itself, this operating system rose to become the preeminent type firearm system of the Twentieth century and is utilized in nearly all modern center fire pistols.

It is recorded that Colt created nearly 200 experimental pistols before producing the model finally accepted by the selection board in 1911. Serviceably accurate, readily disassembled without the use of tools, and extremely rugged in every detail, the model of 1911 has achieved a reputation for combat serviceability unsurpassed by any other military handgun. It is admittedly, however, a difficult weapon to shoot accurately, and during the early 1920's several minor changes to its design were made in an attempt to better its handling qualities. These changes included arched mainspring housing, shorter hammer spur, Partridge-type sights, shorter trigger pull, and longer grip safety horn. These changes eliminated "pinching" of the thumb web, and men with short fingers or small hands welcomed the shorter trigger pull. The Partridge-type sights also improved the sight picture for target shooting purposes. This improved model was designated as the Model 1911-A1.

Despite these improvements, target shooting with the "as issued" service pistol M1911-A1 can be disappointing if the various moving parts are not precisely fitted and adjusted. And, even when the moving parts of the M1911-A1 are precisely fitted, that configuration rarely survives multiple firings. In racetrack terminology, the .45 Colt pistol is a "mudder" designed to function reliably despite having a good deal of foreign matter in its mechanism.

The long tenure of the M1911-A1 has resulted in a design that, while elegantly crafted for its day, has failed to incorporate technological advancements. The M1911-A1 and similar handguns are faced with competitive products that surpass the originally designed M1911-A1 and/or its improved relative, the M1911-A1. Further improvements are needed with respect to accuracy, endurance, reliability and cost. These and other improvements are hereafter disclosed.

BRIEF SUMMARY OF THE INVENTION

Multiple improvements to the M1911-A1 are hereafter described by way of example. Like all M1911-A1s, the improved handgun of the present invention includes a barrel, a frame and a slide as well as other components common to the M1911-A1 that are readily apparent to one skilled in the relevant art. According to one embodiment of the present invention, multiple improvements to the basic M1911-A1 fundamentally change the weapon's accuracy and reliability. Each of the improvements may be implemented singularly or in combination with one or more of the remaining improvements. But when combined, the resulting changes dramatically alter the weapon.

One improvement, according to an embodiment of the present invention, is to modify both the rear and front sights. Unlike the existing M1911-A1, the front sight of the improved handgun is increased in size and includes a plurality of measured gradations that are each viewable from the rear sight. Each gradation represents a different range sight picture that can be used when aiming the weapon. The spacing of the gradations can, in one embodiment of the present invention, be linear, while in another embodiment be non-linear. Regardless of the distribution of the gradations on the front sight, the user of the weapon is provided with instant sighting information for a plurality of ranges. These differing sight pictures (ranges) can be differentiated by adding color codes to the gradations. In another embodiment, the gradations are left uncolored to facilitate night vision enhancement which would highlight the gradations in low-light conditions.

The rear sight is also modified according to one embodiment of the present invention. The improved handgun includes a rear sight that is orientated toward the rear of the handgun and inclined at an acute angle as measured between the surface facing the user and the slide to which the rear sight is attached. The surface facing the user is presented at a slight angle to remove any glare that may be present in forming a sight picture. Furthermore, the surface is serrated or grooved to again minimize any reflection or glare that may hinder aiming of the weapon.

In another embodiment of the present invention the rear sight is comprised of two components for enabling fine adjustments. The rear sight comprises an upper and lower component that is mated together on an inclined surface and secured via a securing device such as a screw or bolt. The surfaces are planer but are embodied with a grid of measured grooves to provide for precise lateral and longitudinal movement. The grooves in the grid are measured to correspond to a predetermined variation in the trajectory of the bullet at a predefined range. Thus a user can adjust the rear sight to compensate for personal variances in shooting technique or to compensate for minor manufacturing variations. The grooved grid ensures that once the sight has been adjusted the weapon will remain sighted-in until future modifications are made.

Another embodiment of the present invention includes improving the safety mechanism to function on both sides of the weapon. An ambidextrous safety mechanism includes a component on the right side of the handgun that interacts with and engages an extended sear chip shaft. According to one embodiment of the present invention, the safety mechanism is retained on the right side of the weapon by forming a notched channel on the interior surface of the right side safety arm.

The notch includes a circular portion in the safety's middle position (neither safe or armed) which is dimensioned to receive the extended end of the sear chip shaft. The end of the sear chip shaft includes a groove/notch that marries with the ridge formed in the interior surface of the safety mechanism. Thus, when the safety arm is in either the safe or armed position, it is secured to the weapon. To remove the safety arm for cleaning and other maintenance, it is placed in a mid-position, which disengages the sear chip shaft from the safety arm.

Another improvement to the M1911-A1, according to one embodiment of the present invention, is a nose piece and nose piece bushing that balances the weapon. The M1911-A1 is inherently out of balance. During recoil of a typical M1911-A1 the weapon moves violently up and generally to the left. This recoil makes it difficult for the user to keep the target under the sight. The recoil is substantially reduced by balancing the weapon. According to one embodiment of the present invention, a nose piece of a predetermined weight and size is attached to the slide via a nose piece bushing. The combined weight of the nose piece and bushing balances the weapon and substantially reduces the recoil. Not only is multiple firing aiming improved, but the forces exerted on the interior mechanisms of the weapon are reduced thus increasing the longevity and reliability of the weapon. Furthermore, the inner diameter of the nose piece shapes the muzzle flash to preclude the loss of night vision. An unmodified M1911-A1 or one using a noise piece with vents produces a muzzle flash that will dramatically reduce a user's night vision as well as magnify the decibel impact of firing the weapon. The nose piece of the present invention channels the expanding gases to reduce noise, muzzle flash and recoil.

The hammer, according to another embodiment of the present invention, is improved to increase the reliability of the handgun. The M1911-A1, in its cocked and ready to fire configuration, presents open apertures into the inner workings of the gun by which dirt or other contaminates can enter and foul the handgun. The sides of the hammer are modified to provide recessed areas in which foreign matter can migrate during movement to preclude seizing or fouling of the weapon. A first modification is to the upper portion of the hammer. The hammer is configured to occupy a void in the end of the slide. To provide for a space in which foreign matter can migrate, the width of the upper portion of the hammer is reduced to form a gap between each edge of the slide.

According to another embodiment, the lower portion of the hammer is also modified to provide for a space in which foreign matter can migrate. The lower portion of the hammer includes two apertures. A first aperture accepts the hammer pin strut and a second aperture receives the hammer pin. According to one embodiment of the present invention, material surrounding the first aperture and the second aperture is eradicated (rebated) leaving a ridge and an area of reduced width surrounding the first aperture and the second aperture.

According to another embodiment of the present invention, lubrication notches are incised into portions of the slide and frame. As tolerances of the improved handgun of the present invention are decreased making the weapon operate more reliably and more accurately, the reliable interaction of various components becomes critical. These minuscule tolerances increase the likelihood of seizing due to increased friction from the heat of repeated firing or fouling due to the introduction of small amounts of foreign matter. As is well known in the art, the slide interacts with the frame during firing by moving in a rectilinear motion along a set of rails. To facilitate this interaction lubrication is introduced. However, the lubrication is fleeting as it is often removed by a repeated firing or by the introduction of the weapon into harsh environments.

According to one embodiment of the present invention, notches are incised into portions of the frame and slide along the region of interaction between these two components. The notches act as reservoirs of lubrication and upon each cycling movement of the slide (firing of the weapon) one or more of the notches is placed opposite a corresponding portion of the slide or frame. The notches themselves are never exposed to the environment and thus retain the lubricant, unlike topically applied material. As a result, the frame and slide are lubricated during each cycle of the slide. The notches also function as a repository for foreign matter that can otherwise foul the slide/frame interaction. Whether it be to lubricate the slide/frame interaction or to act as a repository for foreign matter, the result of the presence of the notches is a significant increase in the reliability of the slide/frame interaction.

The features and advantages described in this disclosure and in the following detailed description are not all-inclusive. Many additional features and advantages will be apparent to one of ordinary skill in the relevant art in view of the drawings, specification, and claims hereof. Moreover, it should be noted that the language used in the specification has been principally selected for readability and instructional purposes and may not have been selected to delineate or circumscribe the inventive subject matter; reference to the claims is necessary to determine such inventive subject matter.

BRIEF DESCRIPTION OF THE DRAWINGS

The aforementioned and other features and objects of the present invention and the manner of attaining them will become more apparent, and the invention itself will be best understood, by reference to the following description of one or more embodiments taken in conjunction with the accompanying drawings, wherein.

Figure 1A:
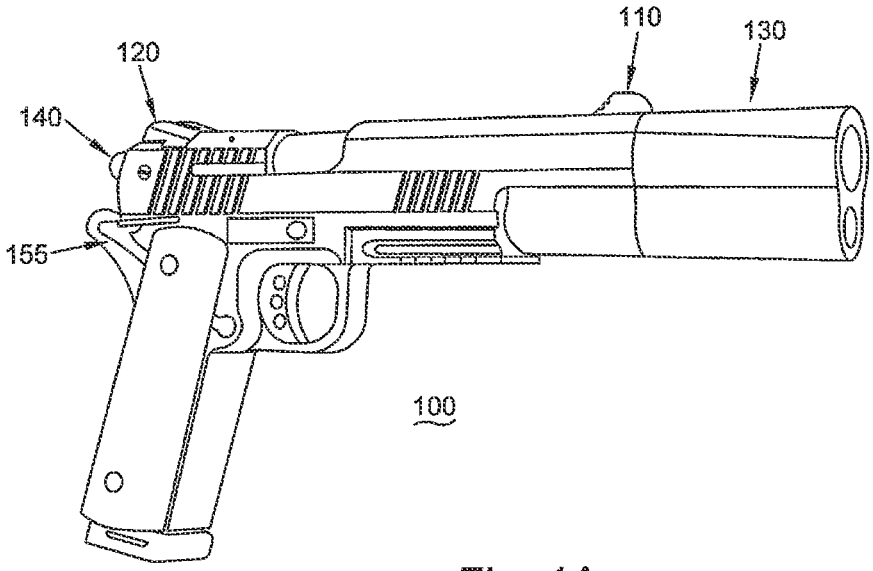
FIG. 1A shows a right-forward perspective view of a handgun system embodying a plurality of improvements according to one embodiment of the present invention.

The Figures depict embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION OF EMBODIMENTS

Specific embodiments of the present invention are hereafter described in detail with reference to the accompanying Figures. Like elements in the various Figures are identified by like reference numerals for consistency. Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

While the present invention is described by way of example via improvement to a M1911-A1 handgun, one skilled in the art will recognize that the improvements presented herein are equally applicable to any handgun and in some situations may be applicable to any weapon system.

Figure 1B:
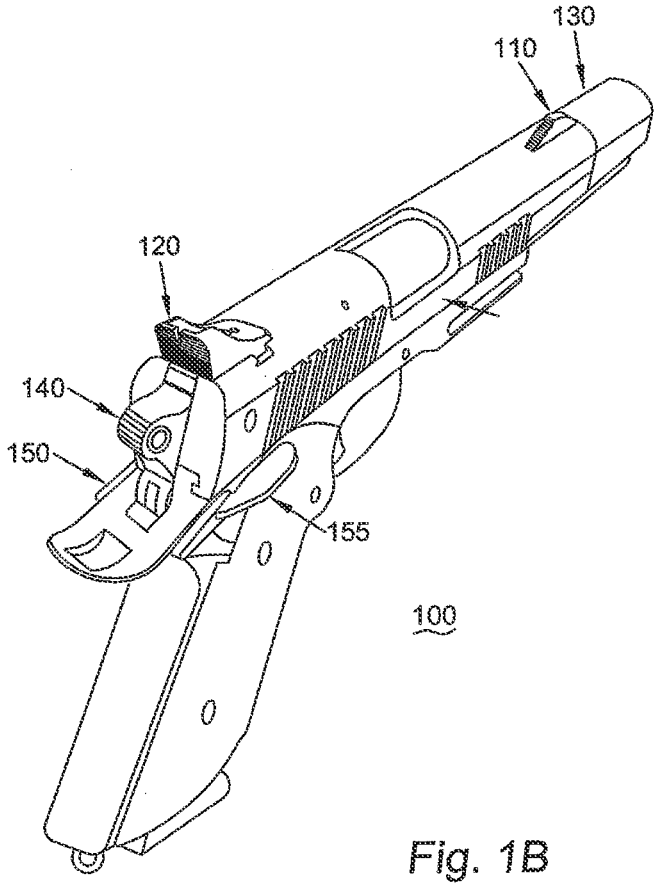
FIG. 1B shows a right-rear perspective view of a handgun system embodying a plurality of improvements according to one embodiment of the present invention.

FIGS. 1A and 1B show a handgun system embodying a plurality of improvements according to one embodiment of the present invention. The new handgun system 100 includes an improved forward sight 110 and an improved rear sight 120 as well as a nose piece 130 and bushing (not shown). Furthermore the new handgun system 100 includes an improved hammer 140 and an ambidextrous safety system 150, 155. Improvements to the new handgun system 100 also exist with respect to the internal workings of the weapon. As will be explained in further detail, improvements to the sear and slide/frame interaction significantly improve the weapon's accuracy and reliability.

According to one embodiment of the present invention, a new sighting system is used that enables the handgun to be accurately employed at various ranges without any manual adjustment to the sights. Many rifles and some handguns include adjustable rear sights to allow the user of the weapon to compensate for range and other factors such as temperature, wind, humidity, etc. that may negatively affect the sighting picture. It is well known that the drop of a projectile over a distance can be compensated for by increasing (or decreasing) the loft of the shot. The degree of how much a projectile will drop over a distance is based on its velocity. In a level shot, a bullet exiting the barrel of a weapon and one simply dropped alongside the weapon will strike the ground at precisely the same time assuming that the ground in front of the weapon along the path of the bullet is level and flat. The projectile fired from the weapon will impact the ground (assuming no obstructions are encountered) at a distance away from the weapon determined by the velocity of the bullet. To hit a target at a certain range, the bullet must be lofted so that after its travel to the target it arrives at the proper height. Thus a target at a longer range would require the projectile to exit the weapon at a higher elevation than a target that is closer. As one skilled in the relevant art will recognize, there are factors other than velocity that control the degree of lofting of a bullet. However, for the purposes of the present invention, these factors are considered minuscule and their discussion is beyond the scope of the present invention.

To compensate for the drop of a bullet, a handgun or weapon of any type is aimed above the target so that by the time the projectile reaches the target it will be coincident with its height. Systems of the prior art adjust elevation of the shot by altering the back aiming sight. By raising the back sight and by keeping the same sight picture, the barrel of the weapon is raised thus compensating for a longer shot. A higher velocity projectile requires less adjustments than a slower bullet. In addition some projectiles, based on their rotational velocity, may induce a lift component, again impacting the degree to which lofting is necessary.

An inherent problem with this method of controlling the amount of loft by adjusting the rear sight is that for each different range the user must alter his firing stance and/or take one hand off the weapon to manipulate the rear sight. In addition the user must lose visual contact with the target. While such a loss of target contact may be acceptable in a benign environment, losing visual with the target in a combat situation may prove deadly.

Figure 1C:
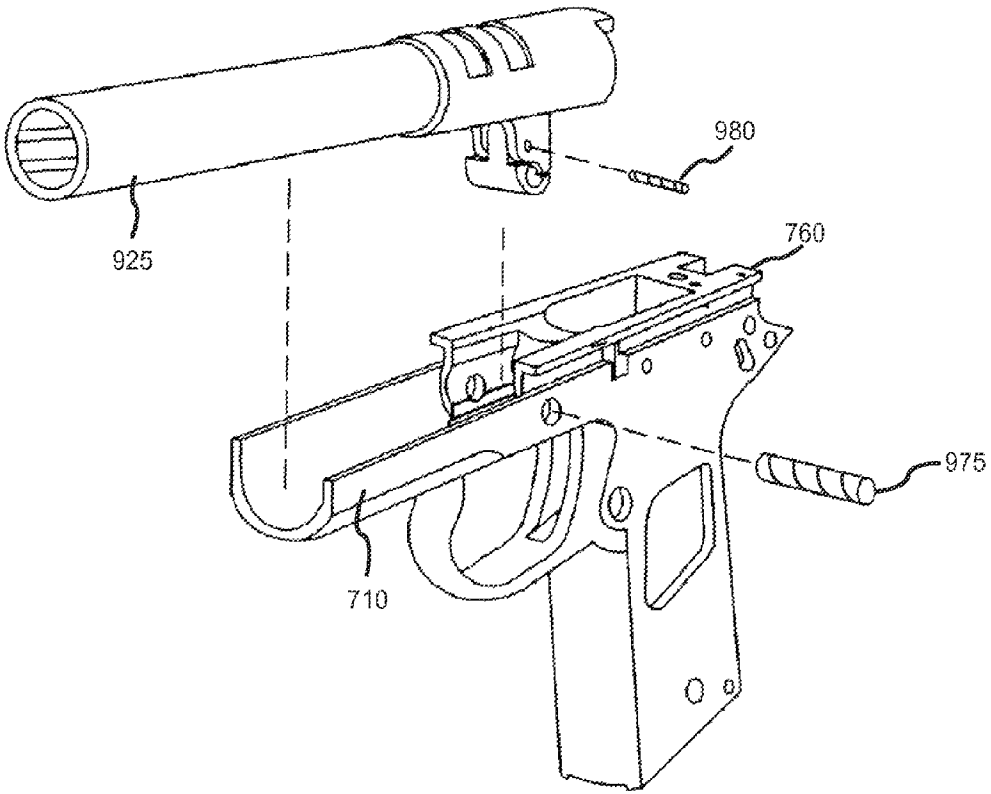
FIG. 1C shows a left-front partially exploded perspective view of a handgun system embodying a plurality of improvements according to one embodiment of the present invention.
Figure 2:
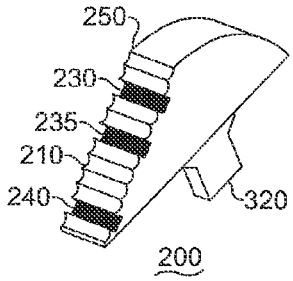
FIG. 2 shows a perspective view of a front sight for an improved handgun system according to one embodiment of the present invention.

FIG. 2 shows a perspective view of a front sight for an improved handgun system according to one embodiment of the present invention This embodiment of the present invention establishes a fixed rear sight and a fixed front sight 200 but includes gradations 210 on the front sight that correspond to various elevation profiles. As shown in FIG. 1, the front sight 200 is fixed to, or is an integral part of, the upper surface of the gradations 210 of the improved handgun system 100. As shown, a lower portion 320 of the front sight is inserted into and joined with the slide. In a normal sight picture, according to one embodiment of the present invention, the top 250 of the front sight 200 is brought to be even or coincident with the frame of the rear sight. In such a manner the target is never removed from the field of view as the sight is brought to bear on the target. The present invention modifies this approach by offering several measured gradations 210 that, depending on range, provide an accurate sight picture. In the present illustration two significant gradations 230 are etched into the front sight. Thus as other targets at differing ranges are acquired, the improved handgun of the present invention can accurately be re-aimed without losing contact with the targets.

For example a short range shot may be one in which the top 250 of the front sight 200 is coincident with the frame of the rear sight. As a target at an increased range is identified, the user raises the barrel such that the next significant gradation 230 in the front sight is brought to coincide with the rear sight frame. Thus the front sight may have gradations of 50 yards, 100 yards, 200 yards, 400 yards, or other distances. These gradations can be referred to quickly and used without losing sight of the target or removing one's grip from the weapon as is required with adjustable sights of the prior art. Each gradation can also, according to another embodiment of the present invention, be color coded. In one embodiment the top 250 of the front sight 200 can be set for a range of 118 yards. The first gradation 230 below the top can be set for a range of 250 yards and colored red. The next gradation 235 can be set at 350 yards and colored yellow and the next gradation 240 can be set for 450 yards and colored green. According to one embodiment of the present invention, each gradation on the front sight is spaced by 0.847 inches as measured from the upper most (top) portion of the sight. As one skilled in the art will recognize, the gradations of the front sight, according to the present invention, can vary based on the desired ranges. A variety of colors can also be used that are easily recognized by the user including the means to make the gradations visible in low-light conditions.

The spacing of the gradations can also vary based on the likely type of projectile being fired. As the elevation profile for various ranges may not be linearly related, the markings are set on the front sight to correspond to a predetermined set of ranges associated with the velocity of the fired projectile. For example, a bullet with a constant velocity would fall according to a geometric arc until it impacted the ground. From the time when the bullet leaves the barrel of the weapon it encounters the atmosphere, which induces drag on the bullet. Thus, the velocity of the bullet decreases. Drag as a function of aerodynamic forces includes both parasitic and induced drag. Parasitic drag includes forces due to the friction of the air impacting the bullet. Induced drag is formed by the bullet's interaction with the air. A detailed discussion of the determination of drag on a bullet over its intended flight path is beyond the scope of the present invention, but it is important to realize that the drag, and thus the velocity of the bullet, is not a linear relationship. Thus the arc which governs the bullet's impact to the ground is not symmetrical. While this difference is insignificant for short range shots, it can be noteworthy as range increases. According to one embodiment of the present invention, the gradations of the front sight are non-linear to accurately reflect the changing velocity of the bullet.

Figure 3A:
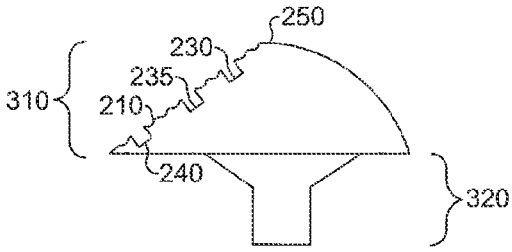
FIGS. 3A and 3B show a side and end view of a front sight for an improved handgun system according to one embodiment of the present invention.
Figure 3B:
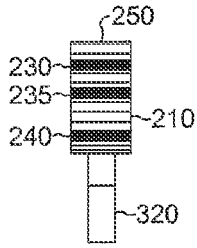

FIGS. 3A and 3B show a side and end view of a front sight 200 for an improved handgun system according to one embodiment of the present invention. The sight 200 comprises an upper portion 310 and lower portion 320. The lower portion 320 is configured to occupy and affix to a recessed area in the slide of the improved handgun of the present invention. The lower portion 320 is fixed to the slide using a plurality of techniques known to one skilled in the relevant art so as to form a permanent bond between the slide and sight 200.

The upper portion 310 of the sight 200 fits flush with the upper surface of the slide and is longitudinally aligned with the slide and thus the barrel when the barrel is in the battery position. The rear portion of the sight 200 includes a plurality of gradations 210 that, as previously described, are incised into the slide at predetermined locations to correspond to specific range sight pictures. The gradations may be linear (as shown) or non-linear.

Figure 4:
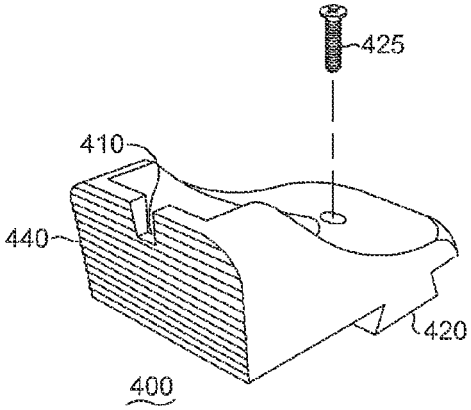
FIG. 4 shows a perspective view of a rear sight for an improved handgun system according to one embodiment of the present invention.

FIG. 4 shows a perspective view of a rear sight for an improved handgun system according to one embodiment of the present invention. The rear sight 400 is oriented facing toward the user to provide a fixed reference on the rear portion of the handgun that will be free of glare or other obstructions. The rear sight 400 is fixed to the slide via a footing configuration 420 that is accepted into a corresponding recess in the slide. According to one embodiment of the present invention, the rear sight can be affixed to the slide via a connector 425 such as set screw, bolt or other form of connector as would be known to one skilled in the art. The angular nature of the footing 420 and recess prevents the rear sight from any longitudinal movement. Lateral movement is prevented by the connecting device 425.

The rear portion of the rear sight 400 includes a rectangular notch 410 on a rectangular face 440 which, when aligned with the front sight 200, enables the user to acquire a target and adjust the elevation of the handgun based on the gradation present in the front sight 200. Thus as viewed from the rear of the rear sight 400 a target at 100 yards might be properly sighted with the front sight 200 substantially filling the notch 410 and the top of the front sight 200 coincident with the top of the rear sight 400. For a target of 350 yards the front sight 200 would again substantially fill the notch 410 but a gradation 235 signifying the prescribed range of 350 yards would now be coincident with the top of the rear sight 400.

According to another embodiment of the present invention, the width of the front sight 200 is configured to substantially fill the notch 410 in the rear sight. With a proper sight picture the front sight will substantially, but not entirely fill the notch. By ensuring that a small amount of space is present on either side of the front sight 200 when viewed in the notch 410 the user can be assured that precise lateral aiming has occurred. Note that the width of the front sight 200 is not the same as the width of the notch 410. Rather the width of the front sight 200 is dimensioned so that when viewed through the notch 410 the front sight 200 substantially fills the space.

Figure 5A:
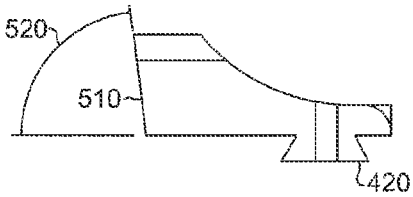
FIGS. 5A-5C show a top, side and rear view of a rear sight for an improved handgun system according to one embodiment of the present invention.
Figure 5B:
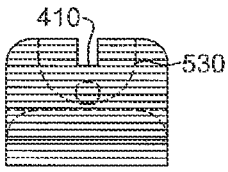
Figure 5C:
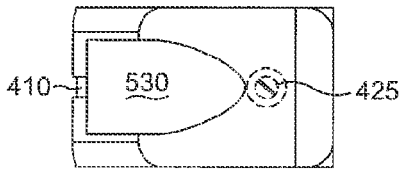

FIGS. 5A-5C show a top, side and rear view of a rear sight for an improved handgun system according to one embodiment of the present invention. Unlike rear sights of the prior art, the rear sight 400 of the present invention includes a rear face 510 that is serrated and angled at an acute angle 520 as measured from the surface of the slide. This inclination of the rear face 510 combined with the serrated surface reduces or prevents any type of reflection or glare that may hinder the user from gaining the proper sight picture. The center portion of the rear sight includes a scalloped area 530 which is void of material and configured to prevent any obstruction from entering the aiming line of sight.

Figure 6A:
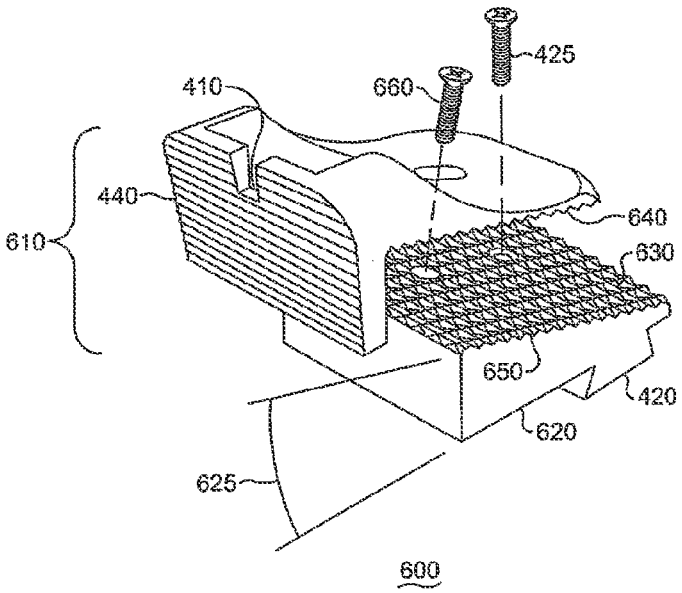
FIGS. 6A and 6B show an exploded perspective and a side view of a modifiable rear sight for an improved handgun system according to one embodiment of the present invention.
Figure 6B:
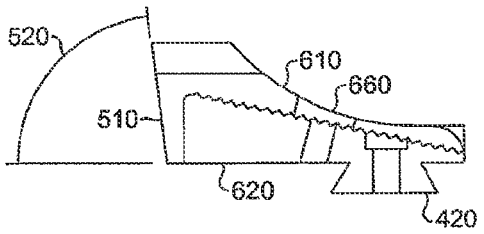

Turning now in addition to FIGS. 6A and 6B, an additional aspect of one embodiment of the rear sight of the improved handgun according to the present invention can be seen. FIG. 6 shows an exploded side view of a rear sight for an improved handgun system. While most configurations of the improved handgun of the present invention include a single piece fixed rear sight, another embodiment of the present invention includes a two component rear sight 600 that enables the user to make fine adjustments to the sighting function of the rear/front sight combination. To make fine range and lateral adjustments, the rear sight can be split into an upper component 610 and a lower component 620. According to one embodiment of the present invention, the upper surface of the lower component 630 of the rear sight is made at an increasing angle 625 from the front of the sight to the rear and with an overhang 635 at the rear portion of the sight. The lower surface of the upper portion 640 and the upper surface of the lower portion 630 include measured, complementary serrations 650. The serrations of the two surfaces form a tongue and groove configuration that both secures the two components and enables precise adjustments of the rear sight. A connector 660, such as set screw, bolt or other device, secures the upper portion 610 to the lower portion 620. The lower portion 620 of the rear sight includes a footing 420 that is secured into a corresponding recess in the slide using a connector as previously discussed.

The serrations 650 on the lower surface of the upper portion 640 and the upper surface of the lower portion 630 are configured into, according to another embodiment of the present invention, a grid. Each serration corresponds to a specific change in the sight picture. For example a lateral movement of the upper portion 610 of the rear sight of one serration with respect to the fixed lower portion 620 may correspond to a ¼ inch lateral displacement of the bullet at a range of 25 yards. Similarly a two serration lateral displacement can correspond to a ½ inch displacement of the bullet at a range of 25 yards. Other degrees of variation can be used and are contemplated without deviating from the scope and spirit of the present invention. Once a precise sight picture has been obtained, the upper portion of the rear sight 610 can be secured to the lower portion 620 of the rear sight by the connector 660.

In the same manner fine range (elevation) adjustment can be made. While the gradations of the front sight 200 enable the user to adjust the loft of the bullet when acquiring a target based on the target's perceived range, the accuracy of those gradations can be adjusted by modifying and securing the rear sight. Just as lateral deviations can be accommodated, so too can range deviations. By sliding the upper portion 610 of the rear sight rearward with respect to the lower portion 620, the notch 410 of the upper portion of the rear sight 400 used for aiming is elevated. Each serration of the interface between the upper and lower portions of the rear sight can correspond to a specific vertical displacement at 25 yards. For example one serration can elevate the upper portion 610 of the rear sight with respect to the lower portion 620 of the rear sight to cause a ¼ inch vertical movement of the bullet at 25 yards. By carefully adjusting the rear sight, a precise and consistent sight picture can be obtained. Once the desired sight picture is obtained, the upper portion of the rear sight is secured to the lower portion of the rear sight using the connector 660.

Another aspect of the present invention includes improvements to the handgun system's reliability. According to one embodiment of the present invention, lubrication notches are established in the frame and slide of the handgun. As the slide traverses over the frame of a handgun due to the recoil action of firing a round, friction is generated. As precision of the interaction between the slide and frame is increased, friction becomes a significant issue. As is well known, the heat generated by the firing of cartridges and from the interactive movement of the components minutely alters the shape of the slide and frame thus decreasing the space between the working components. Furthermore, the recoil motion of the slide with respect to the frame opens the interacting surfaces to foreign matter, which can cause fouling of the slide and impinge on the firing mechanism. It is also well known that to operate reliably the rails on which the slide interacts with the frame must be lubricated. Topical lubrication, while adequate when present, is diminished upon each firing necessitating the weapon to be manually lubricated routinely.

Figure 7:
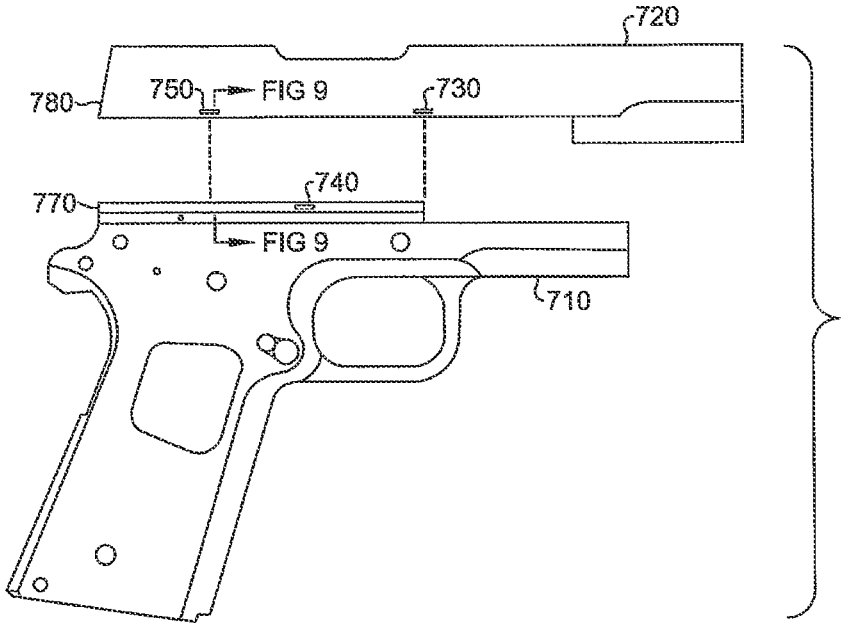
FIG. 7 shows a side view of lubrication channels or slots in the frame and slide of an improved handgun system with the weapon in a battery configuration according to one embodiment of the present invention.
Figure 8:
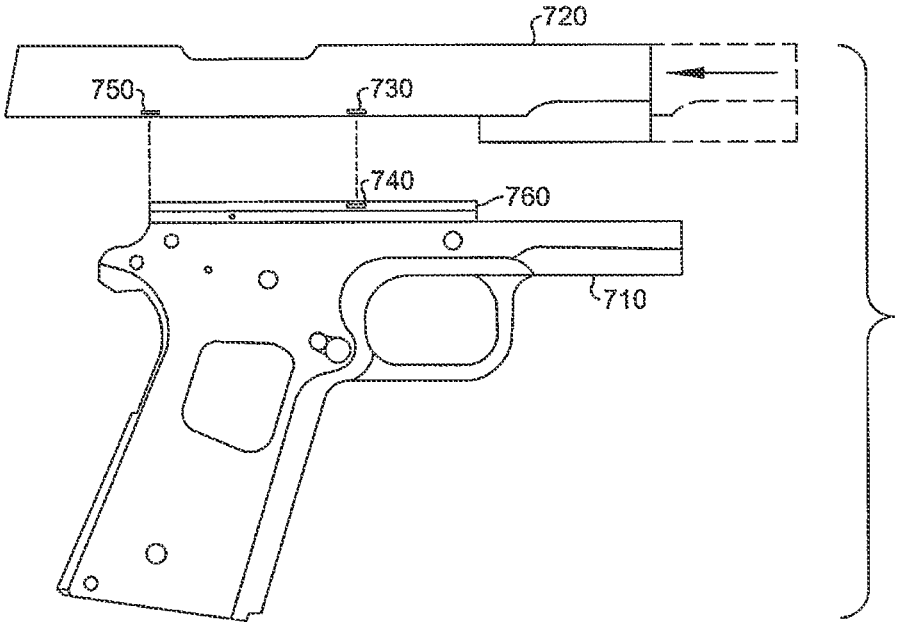
FIG. 8 shows a side view of lubrication channels or slots in the frame and slide of an improved handgun system with the weapon in a fully recoiled configuration according to one embodiment of the present invention.
Figure 9:
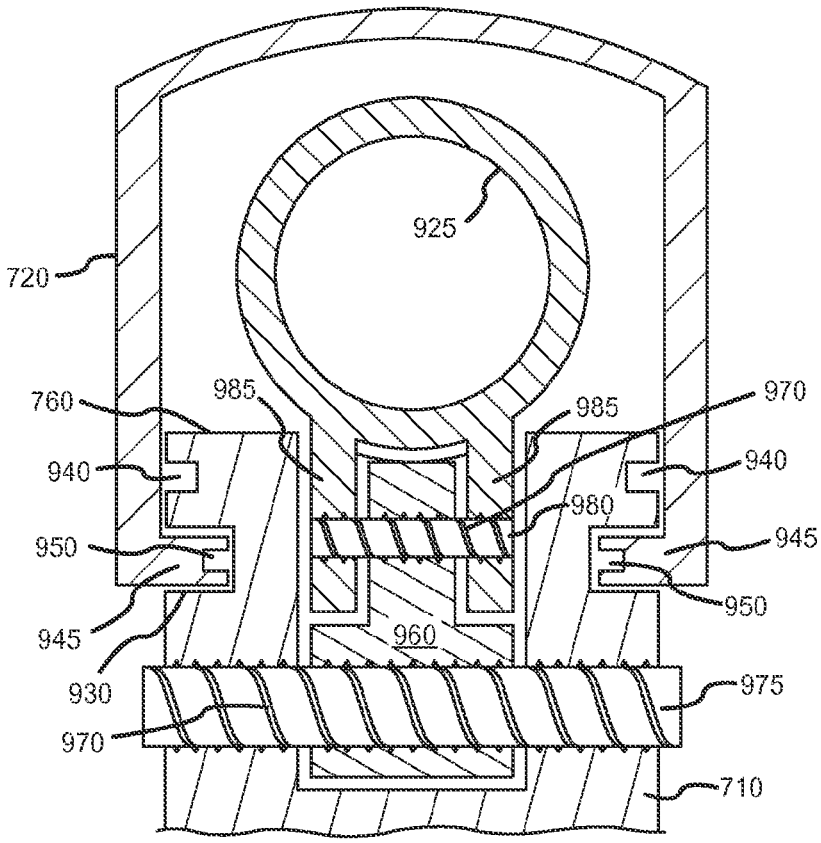
FIG. 9 shows a section cut-away view of lubrication channels or slots in a slide and frame of an improved handgun system according to one embodiment of the present invention.

According to one embodiment of the present invention and as shown in FIGS. 7-9, notches are incised into the interior surfaces of the slide that interact with the frame as well as into the exterior surface of the frame that interacts with the slide. These notches hold a reservoir of lubrication such that when the slide travels about the frame, each portion of the interactive surfaces between the slide and frame pass by at least one of these notches. Upon passing the notch the slide and/or frame is re-lubricated. As the notches face the interactive surfaces between the slide and the frame they are not exposed to the environment and thus maintain the lubricant over extended periods of time and in varying conditions. Furthermore, while the notches hold only a small volume of lubricant, they nonetheless reliably lubricate the slide and frame over multiple cycles, far exceeding that which could be accomplished by a topical application of lubrication. The notches also serve as repositories for foreign matter. The internal components of the M1911-A1, as with many handguns, are exposed to multiple and differing environments. Many of those environments can introduce into the inner components foreign matter. Accordingly foreign matter can migrate to the area in which the slide and frame interact and, upon firing, the foreign matter can foul the slide causing the handgun to jam. In addition to providing a reservoir for lubricant, the notches within the rails of the frame and slide provide an area where foreign matter can be deposited and maintained until the weapon is disassembled and cleaned. In such a manner the likelihood of the weapon ceasing to function due to the introduction of foreign matter is reduced.

FIG. 7 shows a side view of lubrication channels or slots in the frame and slide of an improved handgun system with the weapon in a battery configuration according to one embodiment of the present invention. As shown on a M1911-A1 frame 710, a notch 740 is incised into the exterior portion of the frame 710 on which the slide traverses. According to one embodiment of the present invention, this notch 740 is approximately 1 millimeter in width, 3 millimeters in length, and 1 millimeter in depth. As one skilled in the art will recognize, the actual dimensions of the notches and their orientation with respect to one another may vary without departing from the scope of the present invention.

FIG. 7 further shows the slide 720 in an exploded view but positioned as if it were in a battery configuration. That is positioned as if the weapon was ready to fire. As with the frame, and according to one embodiment of the present invention, the slide 720 includes one or more lubrication notches 730, 750 incised in the guide track on which the frame 710 and slide 720 interact.

FIG. 8 shows a side section view of a frame and slide of an improved handgun system in a fully recoiled configuration having a plurality of lubrication channels or slots according to one embodiment of the present invention. This section view is of the region of the frame in which the notches 740 are incised into the frame 710. The notches 740 are orientated with respect to the slide 720/frame 710 interaction so that a notch 730, 740, 750 is opposite the opposing component (slide or frame) for the entire travel of the slide. As shown in FIG. 8 the notches 740 are incised into what is referred to as the rail 760 of the frame. Note that while only one side view of the frame 710 and notch 740 is shown one skilled in the art will recognize that the frame is symmetrical and that an identical rail and notch exist on the opposing side of the frame. As can be seen by looking in addition to FIG. 9, the rail 760 of the frame 710 is received into a corresponding portion of the slide 720. Similarly the slide 720 includes a tongue portion 945 which fits inside and interacts with a groove or channel 930 in the frame.

FIG. 9 shows a side cut away view of the interaction between the slide and frame, each having lubrication channels or slots in the slide of an improved handgun system according to one embodiment of the present invention. As previously discussed and as known to one skilled in the relevant art, the slide 720 interacts with the frame 710 on a set of rails 760 and grooves 930. The frame 710 includes a channel 930 which accepts a tongue 945 of the side 720 so that it acts to secure the slide 720 to the frame 710 but allows the slide 720 to move in a rectilinear motion along the longitudinal axis of the frame 710. As with the frame 710, one or more notches 950 are incised into the slide 720 that can serve as reservoirs of lubricant. The notches, according to one embodiment are incised into the tongue portion of the slide 720 that interacts with the rail 760 portion of the frame 710.

Note that in the configuration shown in FIG. 9 the notches 940 in the rail 760 of the frame are located above the frame channel 930 while the notches 950 in the slide tongue 945 are located inside the channel 930. In another embodiment of the present invention lubrication notches can be incised into the interior wall portion of the frame channel 930 to facilitate lubricating the tongue and groove (channel) interaction between the frame 710 and slide 720 while notches can also be incised into portions of the slide wall. FIG. 9 shows a notch 950 incised into the side wall of the slide tongue 945. This notch would correspond with the rail 760 of the frame 710 which interacts with the channel 930 of the frame 710. These and other respective configuration and location modifications of the lubrication notches are contemplated by the present invention. The actual incision of the notches into the frame or slide can be accomplished by any number of means that will be readily known to one skilled in the relevant art and will not be discussed further.

In the configuration shown in FIGS. 7-9 the frame includes a single notch 740 on each side of the rail 760 portion of the frame 710. According to one embodiment of the present invention that notch is located 65.25 millimeters from the rear edge 770 of the slide rail 760 (frame) to the center of the notch. Two additional notches 730, 750 also exist incised in each side of the slide's 720 interior channel wall section. The notches 730, 750 incised into the slide 720 are substantially identical to that incised in the frame 710. On each side of the slide 720, a first notch 750 is incised 50 millimeters from the rear edge 780 of the slide and another notch 730 is incised 96 millimeters from the rear edge 780 of the slide.

As one skilled in the art will recognize, the actual size, shape, and orientation of the notches can vary without departing from the scope of the present invention. The arrangement of the notches is established to provide a continual source of lubrication to all surfaces of the tongue/groove combination of the slide and frame throughout the slide's range of motion. Thus, regardless of the slide's position with respect to the frame, at least one lubrication notch will at some point of the range of motion of the slide interact with the opposing component.

As the slide travels backward as the result of the firing of a cartridge to its recoil configuration, the notches 730, 750 on the slide 720 lubricate the rear and the forward sections of the rails 760 of the frame 710. At the same time the notch 740 on the frame 710 lubricates the center portion of the slide 720. Thus in a single cycle of the slide 720 resulting from the firing of the handgun, the entire interactive surface between the frame 710 and slide 720 is lubricated, and while doing so none of the notches are exposed to the environment thus preserving their reservoir of lubrication. Note that the interaction of the slide 720 and frame 710 is, with respect to the lubrication notches, independent of the barrel 925.

The lubrication used to fill the reservoirs is, in one embodiment of the present invention, a nickel based material that possesses high adhesion properties to the slide and frame and is operative as a lubricant over a wide range of temperatures. While possessing a high adhesion property in both cold and hot conditions the lubricant significantly expands as heat is applied thus increasing its ability to lubricate the interacting surfaces in elevated temperature conditions.

The lubrication channels described above can be applied to any interacting components which require reliable lubrication. Another such application is for the interaction between the barrel 925 and the link 960 coupling the barrel to the frame 710 via the barrel link lug 985. As tolerances between the link 960 and the frame 710 are decreased friction is incurred at an increasing rate. Heat due to the friction magnifies the necessity of a reliable source of lubrication. Grooves 970 or notches can be cut into the barrel link pin 980 or slide stop pin 975 securing the link into the frame 710 and/or in the channel wherein the link 960 interacts with the frame 710. As with the interaction of the slide 720 and frame 710, notches containing lubricant can improve the reliability that the two or more components will continue to interact without difficulty. Furthermore should foreign matter be introduced into the link/frame interaction, the matter can be directed to and deposited in the notches to reduce the likelihood of fouling.

Another handgun improvement to the M1911-A1 that can be applied to other weapons is an ambidextrous safety latch. Many models of handguns have safety systems to prevent the weapon from firing. In one version of handguns, a disconnector interacts with the hammer mechanism to prevent the trigger sear chip from releasing the hammer and firing the weapon. In prior versions of the M1911-A1 and in many other handguns, this interaction is only accessible on the left side of the weapon as viewed from the rear of the weapon. Thus in the original M1911-A1 the safety latch was only available on the left side of the weapon. Multiple attempts have been made to create a safety mechanism and latch that can be utilized ambidextrously while still reliably rendering the weapon safe. The most common implementation known in the art extends the thumb safety shaft on which the safety rotates to extend to the right side of the handgun. The thumb safety shaft or connector pin is then coupled to a right side safety latch. Normally the two pieces of the safety, the left and right safety latches, are only joined by a two component thumb safety pin. The pin, however, proves no positive means of securing the right safety latch and thus it often becomes dislodged and cannot be reliably used to safe or arm the weapon.

Figure 10:
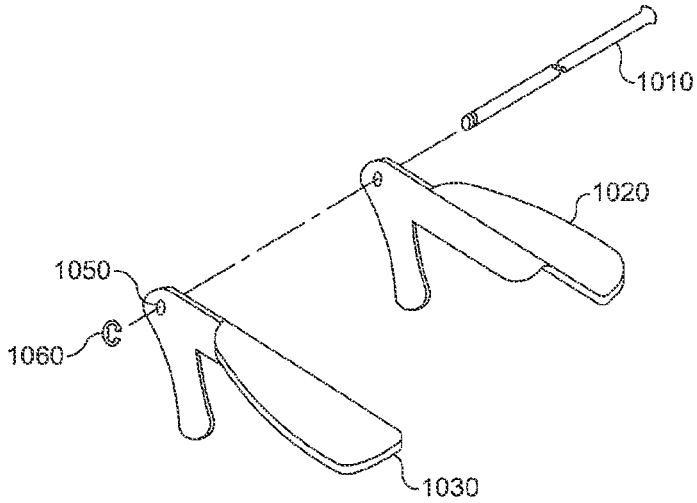
FIG. 10 shows an ambidextrous safety mechanism for an improved handgun system according to one embodiment of the present invention.

FIG. 10 shows an ambidextrous safety mechanism for an improved handgun system according to one embodiment of the present invention. According to one embodiment of the present invention, the thumb safety shaft 1010 for the normal thumb safety 1020 is elongated such that it extends outside of the frame on the right side of the firearm and engages a right side thumb safety 1030. The thumb safety shaft 1010 according to one embodiment of the present invention is oval in shape and is received into an oval receptacle 1050 in the right side thumb safety 1030. The right side safety lever/latch 1030 is coupled to the extended thumb safety shaft 1010 by being accepted into the corresponding oval or d-shaped hole 1050 in the lever and retained, according to one embodiment, by use of a C-clip 1060. As the lever is rotated the thumb safety shaft 1010 correspondingly guides the lever causing the safety lock to be repositioned to either a safe or fire position. The modification enables both right and left handed users to have equal access to the safe functionality of the weapon without necessitating altering the user's grip. The modification also does not significantly alter the inner workings of the trigger/safety mechanism.

Figure 11A:
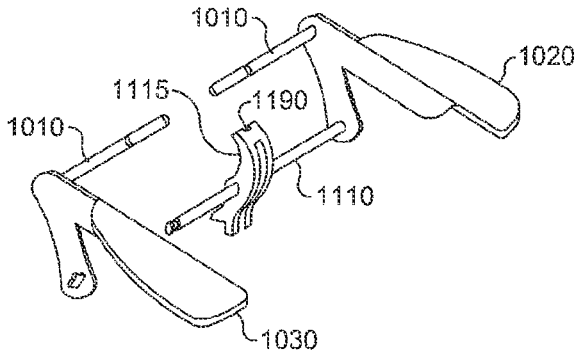
FIGS. 11A and 11B show an exploded view of an ambidextrous safety mechanism for an improved handgun system according to one embodiment of the present invention.
Figure 11B:
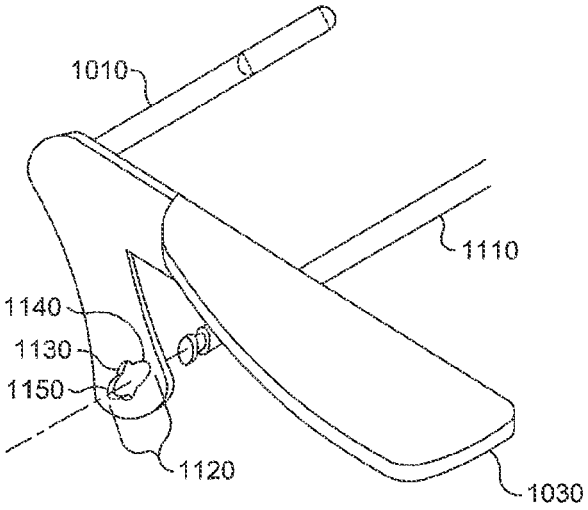

FIGS. 11A and 11B show an exploded view of another embodiment of an ambidextrous safety mechanism for an improved handgun system according to the present invention. Rather than extending the thumb safety shaft 1010 and adding a right side safety arm 1030 as shown in FIG. 10, the thumb safety shaft 1010 is bifurcated and integrated in to each the right side safety arm 1030 and the left side safety arm 1020. The bifurcation is such that when sections of the thumb safety shaft 1010 overlap in the assembled configuration, the iteration between the pieces is such that it couples the two safety arms into a unitary structure enabling simultaneous rotation of the two safety arms 1020, 1030.

In addition the sear pin 1110, on which the sear 1115 rotates, is elongated to extend outside of the frame on the right hand side. The right side safety lever 1030 is fashioned to engage the sear chip shaft 1110. In this manner the right safety arm (lever) 1030 can be positively positioned and retained in either the safe or armed position. A keyway 1120 is machined to accept the extended sear chip shaft 1110 in a central position 1130. Thus when the safety lever is either in the fire position 1140 or safe position 1150, it is positively retained to the handgun. And since the right side safety lever 1030 is positively retained by the sear chip shaft 1110 the thumb safety shaft 1010 does not need a retaining mechanism such as the previously described C-clip 1060. Since the right side safety lever 1030 is retained by the keyway 1120 around the sear chip shaft 1110 the safety mechanism can be disassembled for cleaning of the weapon without removing the previously described C-clip 1060. In addition this embodiment of the present invention can be done without any interaction by the hand grip, as is known to occur in the prior art.

With the weapon being able to be functionally armed or placed into safe mode of operation from either the right or left side, attention can be turned to the performance of the weapon due to the back pressure formed by the firing of a round.

Figure 12:
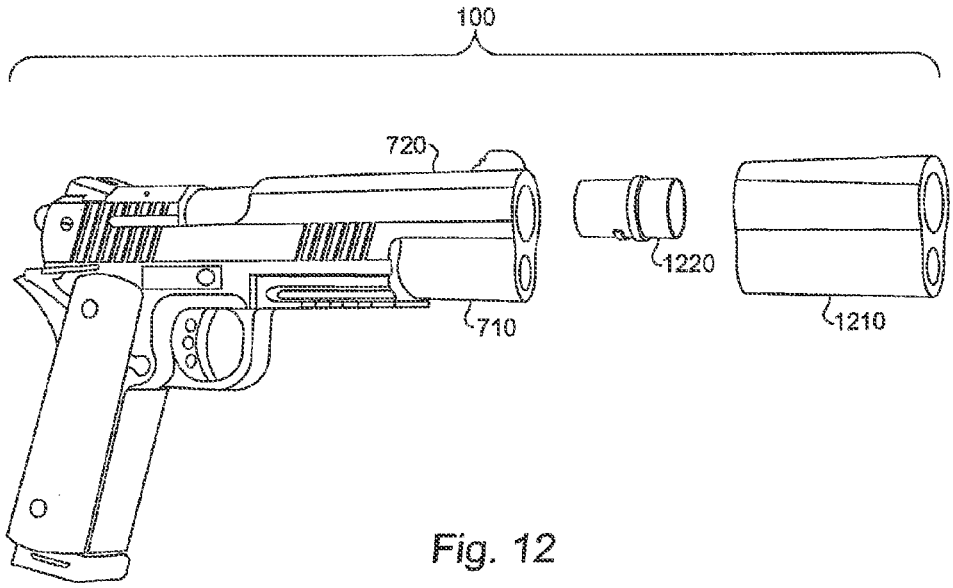
FIG. 12 shows an exploded perspective view of a nose piece and nose piece bushing for an improved handgun system according to one embodiment of the present invention.

FIG. 12 shows an exploded perspective view of a nose piece and nose piece bushing for an improved handgun system. According to another embodiment of the present invention, a modified nose piece 1210 and nose piece bushing 1220 are added to the slide 720 of the handgun. The nose piece 1210, in this version of the present invention, is then coupled to the bushing 1220. Many weapons, including the M1911-A1, are not balanced resulting in excessive force being placed on the barrel link during firing and recoil. In addition the lack of balance of the weapon induces a moment that rotates the gun, typically vertically, during the recoil. A moment is a rotational force applied tangential to the center or rotation. Thus a 1 pound force applied 1 foot from the center of rotation would produce a 1 foot-pound moment. As one skilled in the relevant art will recognize, the same measure of movement can be from a large force over a short distance or a small amount of force over a long distance.

The M1911-A1 is inherently unbalanced. The firing of a round creates a force by which the projectile is launched out of the barrel. The force also causes the slide 720 to recoil over the frame 710 ejecting the spent casing and placing a new round in battery for the next shot. However all of the force not imparted into the round is not used by the recoil of the slide 720. This surplus force is translated to the user via the grip. However the application of this force is not through the center of rotation thus causing a torque resulting in the weapon being displaced off target. By adding a nose piece 1210 to the end of the weapon of sufficient weight and size, thus balancing the weapon, the recoil can be reduced by as much as 25 percent. The placement of additional weight at the end of the slide 720 shifts the center of gravity to be more closely aligned with the application of the force of the firing. Thus a reduced moment is produced, which significantly lessens the tendency of the weapon to pull off target during firing. The alignment of the forces and reduction of the rotational moment also lessens the translated forces on the barrel/link interaction increasing the reliability and ultimately the accuracy of the handgun.

Figure 13:
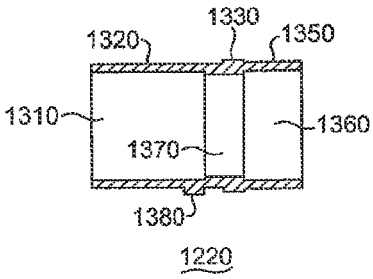
FIG. 13 shows a side view of a nose piece bushing for an improved handgun system according to one embodiment of the present invention.

According to one embodiment of the present invention, the barrel bushing 1220 is modified to accept the nose piece 1210 without interfering with the barrel. FIG. 13 shows a side view of a barrel bushing according to one embodiment of the present invention. While the bushing is shown here as a separate component, the bushing can, in an alternative embodiment, be incorporated into the nose piece forming a single component. The nose piece 1220 extends the slide beyond the end of the barrel when the barrel is in the normal battery position. As can be seen in FIG. 13 one end of the barrel bushing includes a receiving portion 1310 with an interior diameter greater than the exterior diameter of the barrel. Similarly the exterior diameter 1320 of the receiving portion of the bushing 1220 is configured to slide inside the interior diameter of the end of the slide 720. The bushing 1220 slides into and joins the slide 720 until a bushing stop 1330. The bushing stop 1330 forms a ring on the exterior of the bushing marking the boundary between the slide 720 and the nose piece 1210. A bushing lug 1380 secures the bushing into the slide.

The right most portion of the bushing 1220 is configured to be coupled with the nose piece 1210. The exterior diameter of the right most portion of the bushing 1350 is substantially the same, or slightly smaller, as the interior diameter of the receiving portion of the nose piece 1210. The interior diameter of the right most portion 1360 of the bushing 1220 is slightly less than the diameter of the firing chamber of the nose piece, as is explained in more detail below.

The left most exterior portion 1320 of the nose piece bushing 1220 fits within the exterior opening of the slide up to the point of the bushing stop 1330. Similarly the left most opening of the nose piece 1210 fits over the exterior of the right most portion of the bushing 1350 until the nose piece 1210 mates with the slide 720. As shown below with respect to the nose piece, the bushing stop 1330 fits within the receiving portion of the nose piece 1210.

As can be seen in FIG. 13, the bushing 1220 includes a narrowed interior portion or collar 1370. When the barrel 1480 is in its battery configuration the muzzle end of the barrel rests within this collar 1370. Upon firing the slide 720 which includes the bushing 1220 and nose piece 1210 moves rearward. Thus the collar also slides to rearward on the barrel. As the collar 1330 moves rearward the muzzle end of the barrel 1480 enters the interior 1410 of the nose piece 1210 which has a larger diameter than the collar 1370. As this occurs the barrel 1480 is removed from battery and slightly rotates. While this rotation is primarily realized at the rear of the barrel with respect to the locking lugs of the barrel and slide, it occurs to a lesser extent at the muzzle. The movement of the collar, that while in battery assist to stabilize the barrel, to the rear enables the muzzle of the barrel to pivot vertically slightly within the expanded space 1410 found in the interior of the nose piece 1210.

Figure 14A:
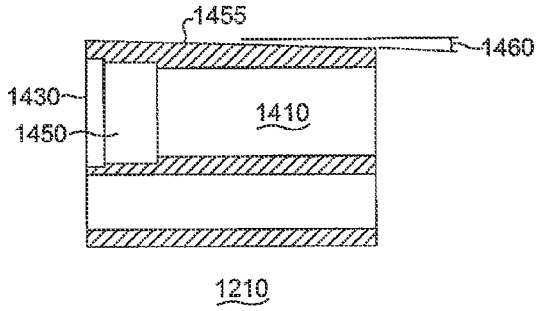
FIGS. 14A and 14B show a side and end view of a nose piece for an improved handgun system according to one embodiment of the present invention.
Figure 14B:
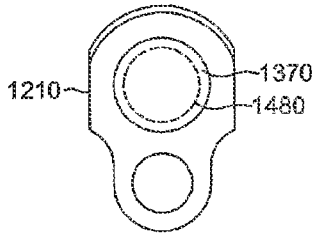

FIGS. 14A and 14B show a side and end view of one embodiment of a nose piece for an improved handgun according to the present invention. As can be seen in the cut away side view the left most receiving portion of the nose piece includes two interior diameters. The larger outer interior diameter 1430 and depth are substantially the same as the exterior diameter and overall length of the bushing stop 1330. The next inner diameter 1450 of the receiving portion of the nose piece 1210 is substantially the same as the exterior diameter 1350 of the right most portion of the bushing 1220. Once coupled to the bushing 1220 the nose piece 1210 and the slide mate thus forming an extended slide component. It should be noted that the interior diameter of the nose piece 1410 is sufficiently large enough to accept the barrel 1480 as the slide and nose piece (and bushing) transition and return from the battery position to the recoil position.

Another advantage to the nose piece 1210 of the present invention over that of the prior art is that the upper surface 1455 of the nose piece 1210 is tapered at a slight angle 1460. The tapering ensures that the nose piece does not interfere with the sighting mechanism of the weapon. For example, a long range shot would require the weapon to be aimed higher than a short range shot. In making the sighting using the front and rear sight associated with the slide, it is possible that the nose piece may interfere with maintaining target contact beyond the front sight. Accordingly the upper surface of the nose piece 1210 is tapered by a slight angle 1460 to prevent any type of sighting incursion. According to one embodiment of the present invention, the range is approximately 3 degrees.

In practice, as the weapon fires and the slide 720 recoils, the nose piece 1210 travels with the slide 720 allowing the barrel to extend into the nose piece 1210 and bushing 1220 making contact only with the collar 1370. As described, this interaction is made possible because the nose piece barrel cavity 1410 is slightly larger than the diameter of the barrel 1480.

According to another embodiment of the present invention, the configuration of the exit hole and barrel cavity 1410 of the nose piece 1210 through which the barrel travels in recoil is of a specific size (diameter and length) in that it captures remaining burning gases and channels them into a specific shape such as a cone over a specific distance whereby they exit, in one embodiment, in the form of a small red ball.

Upon firing, the power within the cartridge burns to form an expanding gas. The expanding gas builds and eventually drives the bullet down the barrel until it exits the end of the barrel. As the bullet exits the barrel, the gases are released at a supersonic rate forming a shock wave at the end of the barrel. Typically the shock wave expands symmetrically around the end of the barrel causing a barrel flash but, according to the present invention, the gases are contained within the nose piece. As the bullet exits, the gases behind the bullet continue to expand. As they do so they form shock waves that reflect off of the interior walls of the nose piece redirecting the shock toward the center axis of the barrel. There the shock waves coalesce forming a ring and thereafter continue until they once again hit the interior walls of the nose piece and again reflect inwardly. The process continues until the end of the nose piece is reached and the gases can escape. During each reflection from the walls of the nose pieces and during each interior meeting of the shocks, the shock ring, the total pressure of the shock is reduced. Thus while the volume of gases exiting the nose piece is the same as that which exits the end of the barrel, the total pressure exiting the noise piece is reduced. The reduction in pressure reduces the recoil stress on the handgun as well as constrains the muzzle flash.

This restriction of the muzzle flash allows the shooter using the pistol at night to retain his "night vision" from an otherwise bright flash. The length and weight of the nose pieces are based on the type of rounds being fired and the overall weight and configuration of the handgun. According to one embodiment of the present invention, the weight of the nose piece for proper balance using a standard round is 5.6 to 5.7 ounces or 158.7 grams. The interior hole diameter 1410 of the nose piece is approximately 15 to 17 mm and the nose piece 1210 is approximately 50 mm long. Once skilled in the art will recognize that these dimensions may vary. As the type of round and charge behind the round are modified, so too may the various dimensions of the nose piece be modified so as to properly balance the firearm and arrest the muzzle flash.

According to another embodiment of the present invention, the nose piece 1210 and/or barrel incorporates one or more lubrication notches as is described previously in association with FIGS. 7-9. As a weapon fires and as expanding gases escape through the nose piece residue and foreign matter can build up and impair the interaction of the barrel with the nose piece and bushing. According to one embodiment of the present invention, one or more notches containing a nickel based lubricant or similar substance can be oriented within the interior surface of the noise piece such that as the barrel traverses the nose piece during firing the exterior surface of the barrel is lubricated. Furthermore each notch serves as a repository for any foreign matter or debris located within the nose piece during the cycling of the barrel. In one configuration two spiraling notches that are directly opposed to one another provide complete coverage of the entire exterior barrel surface during the barrel's limited travel throughout the nose piece.

Just as the notches described above with respect to the nose piece can act as repositories for foreign matter, another improvement to the hammer helps alleviate the impact of residue which can cause a weapon malfunction. One improvement according to the present invention to handguns such as the M1911-A1 is a modification to the width of the hammer. Existing models of the M1911-A1 include a hammer that is of a consistent width when viewed from the rear of the handgun. The width of the hammer in prior models is designed to occupy a void in the rear portion of the slide yet reach forward to make contact with the firing pin as well as interact with the slide during recoil and the sear chip in the interior of the weapon. FIG. 1B shows the hammer 140 in its foremost position occupying a void in the slide. According to one embodiment of the present invention, the width of the upper portion of the hammer is reduced at various locations to produce a gap between each side of the slide interface and the hammer as it rotates in and out of the slide. The gap allows for foreign matter to be extricated from the action during the recoil and cocking process and eliminates any fouling that may occur due to a build up or ingestion of foreign matter.

Figure 15A:
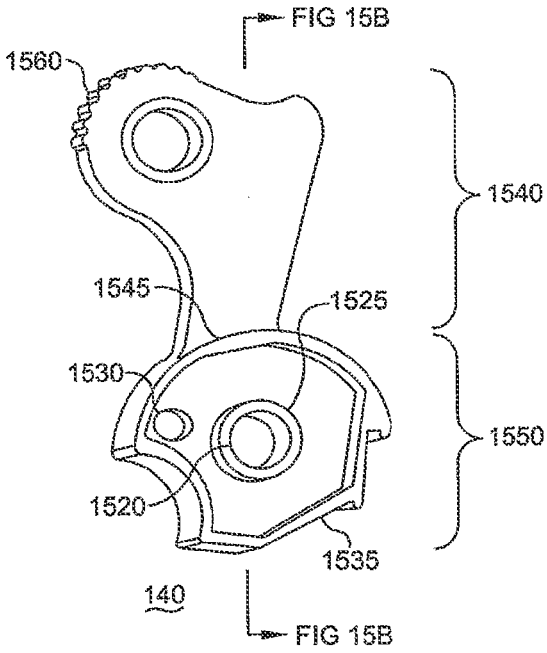
FIGS. 15A and 15B show a side and end view of a hammer for an improved handgun system according to one embodiment of the present invention.

FIG. 15 shows an end view and side view of a hammer as it would be engaged in the slide of an improved handgun system according to one embodiment of the present invention. According to one embodiment of the present invention and as can be seen with reference to FIG. 15A, the width of the lower portion 1550 of the hammer 140 surrounding the hammer pin hole 1520 and the hammer pin strut 1530 remains such that it is fully engaged with the frame (not shown). The upper portion of the hammer 1540 extending above the hammer pin strut 1530 extending to the knurled portion 1560 used for manually pulling the hammer back is reduced in width. According to one embodiment, the width of the hammer is reduced by 1 mm on each side leaving a representative gap between the hammer and the slide when the hammer is in the fully forward position. As one skilled in the art will recognize, the amount of width reduction may vary depending on the particular application and environment in which the handgun is operating.

Rather than offer an access point by which to introduce foreign matter into the internal working parts of the weapon, the gap provides an avenue to allow the weapon to remove matter that would otherwise interfere with the operation of the hammer mechanism. In a handgun's normal cocked position the hammer is retracted leaving a considerable gap in the frame through which a significant amount of foreign matter may, and often does, enter the weapon. If the tolerances between the hammer and the frame are such that no matter can exit, the rotation of the hammer toward the firing pin can impinge on foreign matter causing the hammer to foul or strike the firing pin with insufficient force to fire the round. The gaps between the slide and the hammer provide an avenue by which foreign matter can be extricated away from the hammer so as to not interfere with its rotation.

Figure 15B:
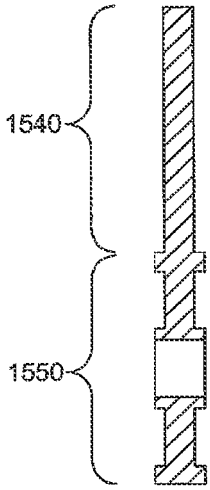

FIGS. 15A and 15B show a side perspective view and an end view of a hammer in an improved handgun system according to one embodiment of the present invention. According to another embodiment of the present invention, the width of the lower portion 1550 of the hammer 140, wherein the hammer interacts with the hammer pin 1520 and the hammer pin strut 1530, can be varied to produce an area to accept foreign matter. As shown the hammer 140 includes two apertures 1520, 1530 for placement of the hammer pin and the hammer pin strut respectively. Material surrounding the hammer pin strut aperture 1530 (hole) is removed leaving a ridge 1535 encompassing the lower portion 1550 of the hammer and the hammer pin aperture 1520. The material immediately surrounding the hammer pin aperture 1520 is maintained at the original width forming a ridge 1525 surrounding the hammer pin aperture 1520. The eradicated material comprises approximately 0.5-1 mm of material on each face of the lower portion 1550 of the hammer leaving corresponding ridges 1525, 1535 of approximately 1 mm in width and depth surrounding the lower face.

In addition and as in the previous embodiment, the upper portion of the hammer 1540 is also reduced in width. The interface between the reduced width upper portion 1540 and the varying width lower portion 1550 is a ridge 1545 that is of sufficient width to interact with the void in the frame. As with the reduction in volume of the upper portion 1540 of the hammer, the removed material from the lower portion 1550 provides a region or space in which foreign material can migrate yet not impinge the action of the hammer. The combined effects of the reduced width of the upper portion 1540 of the hammer and the eradicated material from the lower portion 1550 significantly improve the reliability of the weapon and can form a repository of lubricants.

FIG. 15B shows a side section view of a hammer with varying widths according to one embodiment of an improved handgun system. As shown the upper portion 1540 of the hammer is of a reduced width with respect to at least part of the lower portion 1550 of the hammer. In this particular section the hammer pin aperture 1520 and the hammer pin strut aperture 1530 are coincident. However the ridges 1525, 1535 surrounding the various parts of the lower portion of the hammer 1550 can be seen as can the reduced width of the upper section 1540.

Figure 16:
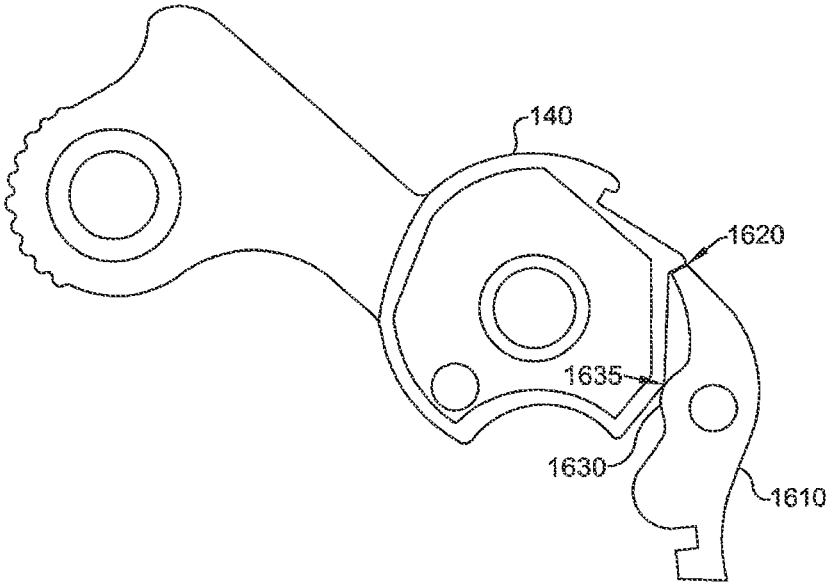
FIG. 16 shows a side view of a sear and hammer in an improved handgun system according to one embodiment of the present invention.

A further improvement to the hammer is obtained by altering the radius of the sear-to-hammer contact point. FIG. 16 shows a side view of a sear and hammer in an improved handgun system according to one embodiment of the present invention. In existing hammer/sear contact designs the sear 1610 impacts the sear ledge 1620 on the hammer 140 and causes the hammer 140 to release, thus firing the weapon. The sear ledge 1620 on the hammer is a very critical geometry of the hammer design. As is well known, upon repeated firings or upon the introduction of foreign matter to the firing/hammer mechanism, the sear ledge 1620 on the hammer may be fouled to the point that the geometry is altered. As a result the weapon may not fire at all or it may fire with less than the expected trigger pull rendering the weapon unsafe. Most handguns resolve this issue by increasing the contact force between the sear chip and the hammer as they interact at the sear ledge. This force is combined with the disconnector spring force and trigger spring to arrive at a force required to fire the weapon. In some cases a force as large as 10 pounds is required to fire the weapon. To reduce the interaction of friction between the springs and the components various techniques have been employed that alter the geometry of the sear ledge. While reducing the force required to fire the weapon, such a modification also increases the likelihood that the weapon can fire autonomously.

According to one embodiment of the present invention, the force required to fire the weapon is reduced while maintaining optimal force and contact between the sear chip 1610 and the hammer 140 at the sear ledge 1620. FIG. 16 shows a side view of a sear and hammer in an improved handgun system according to one embodiment of the present invention that reduces the force necessary to fire the weapon while maintaining optimal sear ledge contact. According to one embodiment of the present invention the radius 1630 of the lower portion of the sear chip 1610 is enlarged to cause the sear chip 1610 to engage 1635 the hammer 140 below the sear ledge 1620. As the sear chip 1610 rotates a force is applied to the lower portion of the hammer 140 acting as a lever with respect to the rotation of the sear chip 1610. The result is a reduced force at the sear ledge 1620 making the removal of the sear chip 1610 from the sear ledge 1620 more efficient. Prior to this secondary contact the sear chip 1610 is fully engaged. And rather than inherently reducing this engagement as is done in the prior art, this embodiment of the present invention removes the force between the sear chip 1610 and the hammer 140 at the sear ledge 1620 by forming a fulcrum 1635 below the ledge that interacts with the hammer. The result is a lower trigger pull that is reliable, consistent and safe.

According to another embodiment of the present invention, the intersection of the two faces on the hammer's edge forming the sear ledge is modified. Normally the sear ledge is a 90 degree corner in which the sear engages the hammer. According to one embodiment of the present invention the geometry of the two intersecting faces is modified by placing a cavity or notch 1190 in the surface of the sear chip at the intersection of the sear ledge and sear chip extending below the contacting face of the sear chip. This corresponds to a notch present in the hammer. The region of void extending below the sear chip allows foreign matter to be deposited so that the mechanical interaction between the sear chip and the hammer remains consistent and reliable.

Presented herein are various improvements to a hand gun resulting in a hand gun system that possesses increased reliability and accuracy. While any one of the improvements described herein can be implemented individually in any hand gun or other firearm, a combination of these improvements can produce a compounding effect of increased reliability and accuracy. The M1911-A1 as originally produced advertised a maximum range of some 1600 yards with an effective range of only 50. This meant that while the round could reach out in excess of a 1600 yards it could only be effectively aimed and employed at a range of 50 yards. Said another way, the M1911-A1 as originally produced, is a defensive short range weapon. Many of the reasons for his discrepancy have been addressed by one or more of the embodiments of the present invention. By implementing one or more of the improvements described in detail herein a fire arm such as the M1911-A1 can be used as an offensive weapon rather than be limited to one use in a defensive posture. Rather than a having an effective range of only 50 yards hand guns utilizing the improvements described herein have been shown to produce a target pattern spread at 450 yards of less than the width of a man. This vastly improves the usefulness and versatility of the weapon and gives a user additional confidence that, when used properly, a round expended by the improved hand gun system of the present invention will hit its mark; near or far.

As will be understood by those familiar with the art, the invention may be embodied in other specific forms without departing from the spirit or essential characteristics thereof. And while the present invention is described as a plurality of discrete improvements, any or all of the improvements may be combined in any combination or used singularly. Likewise, the particular naming and division of the components, pieces, mechanisms, workings and other aspects are not mandatory or significant, and the mechanisms that implement the invention or its features may have different names, divisions, and/or formats. Furthermore, as will be apparent to one of ordinary skill in the relevant art, the improvements, components, mechanisms, workings and other aspects of the invention can be implemented using various material. It is also recognized that the teachings of the foregoing disclosure will suggest other modifications to those persons skilled in the relevant art. Such modifications may involve other features that are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The Applicant hereby reserves the right to formulate new claims to such features and/or combinations of such features during the prosecution of the present application or of any further application derived therefrom.

I claim:

1. A firearm lubrication system, comprising:

a frame;

a slide; and a plurality of lubrication notches wherein at least one of the plurality of lubrication notches is incised into a first component of a pair of opposing moving components of a firearm such that the at least one of the plurality of lubrication notches is arranged to be opposite a planar surface of a second component of the pair of opposing moving components over a relative motion of travel wherein a first portion of the plurality of lubrication notches is incised into a surface of a tongue of the slide and a second portion of the plurality of lubrication notches is incised into a surface of a channel in the frame, said surface of the slide interacting with and opposing said surface of the frame.

2. The firearm lubrication system of claim 1, wherein each lubrication notch acts as a reservoir for a nickel based lubricant.

3. The firearm lubrication system of claim 1 wherein the first portion of the lubrication notches and the second portion of the lubrication notches are configured to lubricate an entire relative motion of travel.

4. The firearm lubrication system of claim 1 wherein the slide slidably interacts with the frame over a distance of travel and wherein at least one of the plurality of lubrication notches faces either the frame or the slide over all of the distance of travel.

5. The firearm lubrication system of claim 1 wherein the plurality of lubrication notches is isolated from environmental conditions.

6. The firearm lubrication system of claim 1 wherein the plurality of lubrication notches provide continual lubrication over the relative motion of travel.

7. The firearm lubrication system of claim 1 further comprising:

a barrel having a barrel link lug;

a frame; and a link coupling the barrel to the frame, wherein the link is coupled to the frame by a slide stop pin and the barrel is coupled to the link by a barrel link pin via the barrel link lug and wherein a first portion of the plurality of lubrication notches is incised into a surface of the barrel link pin and a second portion of the plurality of lubrication notches is incised into a surface of the barrel link lug configured to receive the barrel link pin, said surface of the barrel link lug interacting with and opposing said surface of the barrel link pin.

8. The firearm lubrication system of claim 1 further comprising:

a barrel;

a frame; and a link coupling the barrel to the frame, wherein the link is coupled to the frame by a slide stop pin and the barrel is coupled to the link by a barrel link pin and wherein a first portion of the plurality of lubrication notches is incised into a surface of the slide stop pin and a second portion of the plurality of lubrication notches is incised into a surface of the link configured to receive the slide stop pin, said surface of the link interacting with and opposing said surface of the slide stop pin.

9. The firearm lubrication system of claim 1 further comprising:

a barrel;

a frame having a frame link lug; and a link coupling the barrel to the frame, wherein the link is coupled to the frame by a slide stop pin via the frame link lug and the barrel is coupled to the link by a barrel link pin and wherein a first portion of the plurality of lubrication notches is incised into a surface of the slide stop pin and a second portion of the plurality of lubrication notches is incised into a surface of the frame link lug configured to receive the slide stop pin, said surface of the frame link lug interacting with and opposing said surface of the slide stop pin.

10. A firearm lubrication system comprising:

a barrel;

a frame;

a plurality of lubrication notches wherein at least one of the plurality of lubrication notches is incised into a first component of a pair of opposing moving components of a firearm such that the at least one of the plurality of lubrication notches is arranged to be opposite a planar surface of a second component of the pair of opposing moving components over a relative motion of travel; and a link coupling the barrel to the frame, wherein the link is coupled to the frame by a slide stop pin and the barrel is coupled to the link by a barrel link pin and wherein a first portion of the plurality of lubrication notches is incised into a surface of the barrel link pin and a second portion of the plurality of lubrication notches is incised into a surface of the link configured to receive the barrel link pin, said surface of the link interacting with and opposing said surface of the barrel link pin.

11. A method for lubricating firearm components wherein the firearm includes a slide and a frame, the method comprising:

incising a plurality of lubrication notches into opposing moving components of a firearm including incising a first portion of the plurality of lubrication notches into a surface of a tongue of the slide and incising a second portion of the plurality of lubrication notches into a surface of a channel of the frame and wherein the first portion of lubrication notches are configured to oppose a planar surface of the frame and the second portion of lubrication notches are configured to oppose a planar surface of the slide over an entirety of a relative motion of travel and interaction between the slide and frame; and filling each of the plurality lubrication notches with a nickel based lubricant.

12. The method for lubricating firearm components of claim 11 wherein the firearm includes a barrel, a frame and a link wherein, via a barrel link pin, the link is coupled to the barrel and wherein incising includes incising a first portion of the plurality of lubrication notches in a surface of the barrel link pin and a second portion of the plurality of lubrication notches into the link.

13. The method for lubricating firearm components of claim 11 wherein the firearm includes a barrel, a frame and a link wherein, via a slide stop pin, the link is coupled to the frame and wherein incising includes incising a first portion of the plurality of lubrication notches in a surface of the slide stop pin and a second portion of the plurality of lubrication notches into the link.

14. The method for lubricating firearm components of claim 11 wherein the firearm includes a barrel, a frame and a link wherein, via a barrel link pin, the link is coupled to a barrel link lug associated with the barrel and wherein incising includes incising a first portion of the plurality of lubrication notches in a surface of the barrel link pin and a second portion of the plurality of lubrication notches into the barrel link lug.

15. The method for lubricating firearm components of claim 11 wherein the firearm includes a barrel, a frame and a link wherein, via a slide stop pin, the link is coupled to a frame link lug associated with the frame and wherein incising includes incising a first portion of the plurality of lubrication notches in a surface of the slide stop pin and a second portion of the plurality of lubrication notches into the frame link lug.

* * * * *